US005929810A

United States Patent [19]

Koutsoudis et al.

[11] Patent Number: 5,929,810

[45] Date of Patent: Jul. 27, 1999

[54] IN-FLIGHT ANTENNA OPTIMIZATION

[75] Inventors: Theodore Koutsoudis, Farmingdale; Justine D. Cermignani, Fort Salonga, both of N.Y.

[73] Assignee: Northrop Grumman Corporation, Los Angeles, Calif.

[21] Appl. No.: 08/994,809

[22] Filed: Dec. 19, 1997

[51] Int. Cl.[6] ..... H01Q 3/24

[52] U.S. Cl. ..... 342/373; 342/81; 342/174; 342/368

[58] Field of Search ..... 342/81, 174, 154, 342/368, 372, 373

[56] References Cited

U.S. PATENT DOCUMENTS

| | | | |
|---|---|---|---|
| 3,787,850 | 1/1974 | Sletten et al. | 343/7.7 |
| 3,858,208 | 12/1974 | Parke et al. | 343/7.5 |
| 4,488,155 | 12/1984 | Wu | 343/376 |
| 5,229,776 | 7/1993 | Kelly et al. | 342/173 |
| 5,283,587 | 2/1994 | Hirshfield et al. | 342/372 |
| 5,530,449 | 6/1996 | Wachs et al. | 342/174 |

*Primary Examiner*—Gregory C. Issing
*Assistant Examiner*—Dao L. Phan
*Attorney, Agent, or Firm*—Terry J. Anderson; Karl J. Hoch, Jr.

[57] ABSTRACT

A method and system for phased array radar antenna calibration to be made in flight employs a synthesized initial transmission signal having a notch in the main direction of beam. This has the effect of returning reflected receiver signals that are main lobe clutter free, but contain clutter returned solely from the sidelobe radiation. The received clutter data is processed to yield a set of coefficients that, when combined with subsequent radar signal return resulting from a signal having a main lobe, provides a return signal that is free from aircraft induced distortions and misalignments that can result in sidelobe induced false alarms. All data processing is conducted in the time domain rather than the frequency domain, thus, avoiding Doppler frequency foldover problems due to ambiguities from signals received at multiple aspect angles.

17 Claims, 5 Drawing Sheets

IN-FLIGHT ANTENNA OPTIMIZATION

FIELD OF THE INVENTION

The present invention relates to a radar antenna calibration method and system for phased array radar used in airborne early warning surveillance systems.

BACKGROUND OF THE INVENTION

The detection range of search radar is limited by the curvature of the earth, making it difficult for ground based radar to detect very low level flying aircraft. One solution is to carry Airborne Early Warning (AEW) radar systems aboard search aircraft. However, existing AEW surveillance and interceptor radar systems in general have difficulty reliably detecting and therefore tracking low altitude targets at a large enough range to permit effective fire control responses. In spite of such difficulty, detection of these targets improves with better control over antenna characteristics, especially with respect to pointing angles, sidelobe suppression and operating frequencies.

The basis for directivity control in a phased array antenna system is radio frequency (RF) wave interference, and by providing a large number of equally spaced antenna elements fed from in phase currents, maximum directivity in a forward direction can be achieved. By modifying the phase angles of the electric signals representing a transmitted or received electromagnetic wave, a stationary antenna array can transmit and receive RF from different angles. With multiple antenna elements configured as an array, it is also possible, with a fixed amount of power, to greatly reinforce radiation in a desired direction, while suppressing radiation in undesired directions. However, a common problem with arrayed configurations is that a large number of sidelobes are apt to be present in the radiation field. These sidelobes are often undesirable, since they tend to consume power and reduce detection sensitivity. In general, the problem of undesirable sidelobes can be reduced by harmonizing or calibrating the antenna and the transmission system.

FIG. 1 depicts a conventional phased array radar apparatus disclosed in Japanese Patent Public Disclosure (Kokai) No. 63-167287. A phased array antenna 1 of elements 100-1 to 100-M are connected to respective transmission and receiving modules RM-1 to RM-M. A circulator 2 permits the use of each antenna element as a transmitter and a receiver element, referred to as duplex operation. The transmission side of the module RM is fed two transmission beam parameters, a pulse train F1 and a phase angle DP1 of the desired electromagnetic radiation field. Typically, the pulse train is formed in a system (not shown) that includes a pulse divider and an oscillator which combine to produce a predetermined pulse modulation consisting of a plurality of pulses. The pulses are coupled functionally to a transmitting pulse distributor 101 and to a phase shifter 5 located in modules RM-1 through RM-M. A transmitting beam controller 102 is operative, based on data derived from the received signal representing azimuth and distance, to determine phase shift parameters that would effectively direct the antenna's radiation in the desired direction. The beam controller 102 sends the result, labeled DP1 through DPM, to respective ones of the phase shifters 5 located in modules RM-1 through RM-M. Respective ones of the modules apply input signals to their respective power amplifiers to form a high energy output pulse to each of the respective antenna elements 100 through 100-M.

A typical transmit radiation pattern, prior to implementation of the invention, is depicted in FIG. 4, and has a main beam transmit lobe 408 and sidelobes 410. The ordinate axis is a measure of relative electromagnetic signal strength as a unit of power, and the abscissa is a measure of the radiation direction angle in degrees as measured from a line perpendicular to the plane of the antenna array 1. An objective of radar antenna design is to create a narrow beam width, low antenna dispersion, uniform field radiation and low sidelobe levels. Broadside arrays of Yagi antennas, characterized by a direction of maximum radiation perpendicular to the line or plane of the array, are typically used in these applications.

Most objects are capable of reflecting RF waves, but the degree to which RF power is reflected in the direction of the receiving antenna array 1 depends on the atmospheric conditions, weather, size and shape of a reflecting object, maximum radar range of the system, angle of the return and the characteristics of the RF transmit pattern. A transmitted radiation pattern as depicted in FIG. 4 has a main beam 408, which contributes to returns reflected along a line of zero degrees, and a series of sidelobes 410 focused at differing solid angles, which likewise contribute to returns reflected from their respective complementary directions.

Upon reception (FIG. 1), RF radiation from a reflected target is received, at the antenna array 1. For example, input supplied by the antenna element 100-1 is passed through circulator 2 to module RM-1 of receiver 3 where it is demodulated into an intermediate frequency and separated into its in-phase and quadrature components. Each antenna element 100-1 through 100-M sends its output to the respective RM module. The received signal components are converted from an analog signal to a pair of digital signals R1 representing its phase and amplitude. The digital signals R1 are sent to a distributor 400 where they are combined with digital signals R2 through RM, respectively, from the receiving modules RM-1 through RM-M. The distributor 400 outputs the set of digital signals R1 through RM, to a set of beam forming circuits 500-1 through 500-M, which are adapted to control as desired the phase and the amplitude of the reception data R1 through RM, and provide reception beams in the direction of the target. The degree to which an RF system is capable of controlling the accuracy of the phase and amplitude of the radiation pattern will determine the ability of the radar to detect difficult targets at ranges that permit the detection necessary for effective fire control responses.

The ability to distinguish a true target echo from noise by a phased array radar system during use of all the antenna elements 100-1 through 100-M is important to the success of AEW surveillance radar. Low on-aircraft antenna radiation patterns improve overall detection performance and also avoid inducing false alarms caused by undesirable sidelobes. The proximity of the electrically conductive skin of an aircraft is a contributing factor to the configuration of the sidelobes. During calibration of antenna systems, use may be made of advanced technologies in antennae calibration and adaptive processing algorithms to compensate for the aircraft reflections.

Current antenna calibration schemes generally require that the measurements and adjustments be made on the ground. In addition there are typical requirements for test signals to be designed into the radar systems or provided through external signal generators. This is a time consuming and costly procedure. As phased array radar applications are pushed to new limits, new and novel calibration techniques must follow.

SUMMARY OF THE INVENTION

This invention addresses a method and a system that allows accurate antenna calibration, to be made in flight, and which increases the accuracy of the radar, eliminates ground based calibration and overall reduces the cost of conventional calibration practices. The present invention provides returning RF reflected receiver signals that are substantially clutter free in the main lobe, but contain clutter returns solely from the sidelobe radiation. The received clutter data is processed to yield a set of coefficients that, when combined with subsequent RF signal returns, provide a return signal that minimizes aircraft induced distortions and misalignments that can result in sidelobe induced false alarms.

As part of the antenna calibration process described herein, a broad unidirectional RF pattern with a notch in the desired main beam direction is used both to transmit a radar signal and to collect received clutter data. Data from a single radar pulse is sufficient for each antenna beam orientation, thus reducing data processing time. Furthermore, all data processing is conducted in the time domain, rather than the frequency domain, thus, avoiding Doppler frequency foldover problems due to ambiguities from signals received at multiple aspect angles. Received RF data is then processed by an antenna optimization algorithm without the need of filters to remove the main beam clutter. The advantages of this in-flight antenna pattern optimization is that it provides an initial set of on-aircraft, low sidelobe level, feeding coefficients to a phased array radar system without the need of costly, time consuming, antenna element pattern measurements.

Accordingly one aspect of the present invention provides for an apparatus to synthesize a single test signal comprising a radar transmit pulse having a notch about the desired pointing angle in the main beam. The desired transmit pulse radiation pattern is synthesized by superimposing the feeding coefficients of a number of scanned patterns with one at the boresight. Upon subtraction of each of these scanned patterns from the boresight unscanned pattern, a single beam is obtained which has a broad rectangular main lobe notch about the antenna boresight.

Utilizing an electronically scannable omni-beamformer, a pulse is transmitted through a phased array antenna system. The radar system then awaits the return signals, which essentially consist of one or more analog signals with phase and quadrature components, representing different return ranges categorized according to the time of reception. These are fed into an optimization adaptive processor to compute a set of feeding coefficients for each element of the antenna array. The adaptive processor forms a covariance matrix to which is applied a modified Weiner-Hopf algorithm. Cross correlation terms are computed and the matrix is inverted and post multiplied by a steering vector for each element of the antenna array. The foregoing procedure provides a table of coefficients for optimization which are stored and later combined with received signals to produce an output beam with controlled sidelobe response, effectively correcting for aircraft induced distortions and misalignments.

Further, according to another aspect of the present invention, there is provided a method for optimizing a phased array antenna radiation pattern aboard an aircraft following the steps of: synthesizing a radar transmission signal (or pulse) radiation pattern having a notch in the main lobe, and transmitting the pulse through the phased array antenna system. Thereafter, the radar receives RF signals representing different return ranges of targets and inputs the signals as digital data into a optimization adaptive processor. The optimization adaptive processor includes the steps of forming a covariance matrix, applying a modified Weiner-Hopf algorithm, computing cross correlation terms, inverting the matrix and post multiplying the matrix by a steering vector for each element of the antenna array. A single feeding coefficient for each element of the array is thereafter applied to subsequently received return signals to correct for aircraft induced distortions and misalignments.

The calibration method described herein provides for low level on-aircraft antenna patterns transmitted at any pointing angle and under various radar operating conditions. This approach has a number of distinct advantages over other antenna calibration schemes. For example, the antenna does not have to be calibrated on the ground, and the need for a built in test signal and its associated distribution network is eliminated. This has the potential of alleviating the need for ground testing and antenna range measurements for performing antenna optimization.

Therefore, it is an object of the present invention to increase the accuracy of detection of targets utilizing a phased array radar.

A second object of the present invention is to eliminate ground based antenna calibration and to reduce the cost of calibration.

Another object of the present invention is to implement antenna calibration data processing in the time domain to avoid a Doppler frequency foldover problem.

BRIEF DESCRIPTION OF THE DRAWINGS

The novel features of the present invention are set forth with particularity in the appended claims. The invention itself, however, both as to its organization and method of operation, together with further objects and advantages thereof, may be best understood by reference to the following description taken in conjunction with the accompanying drawings, in which:

DESCRIPTION OF THE PREFERRED EMBODIMENTS

Figure 1:
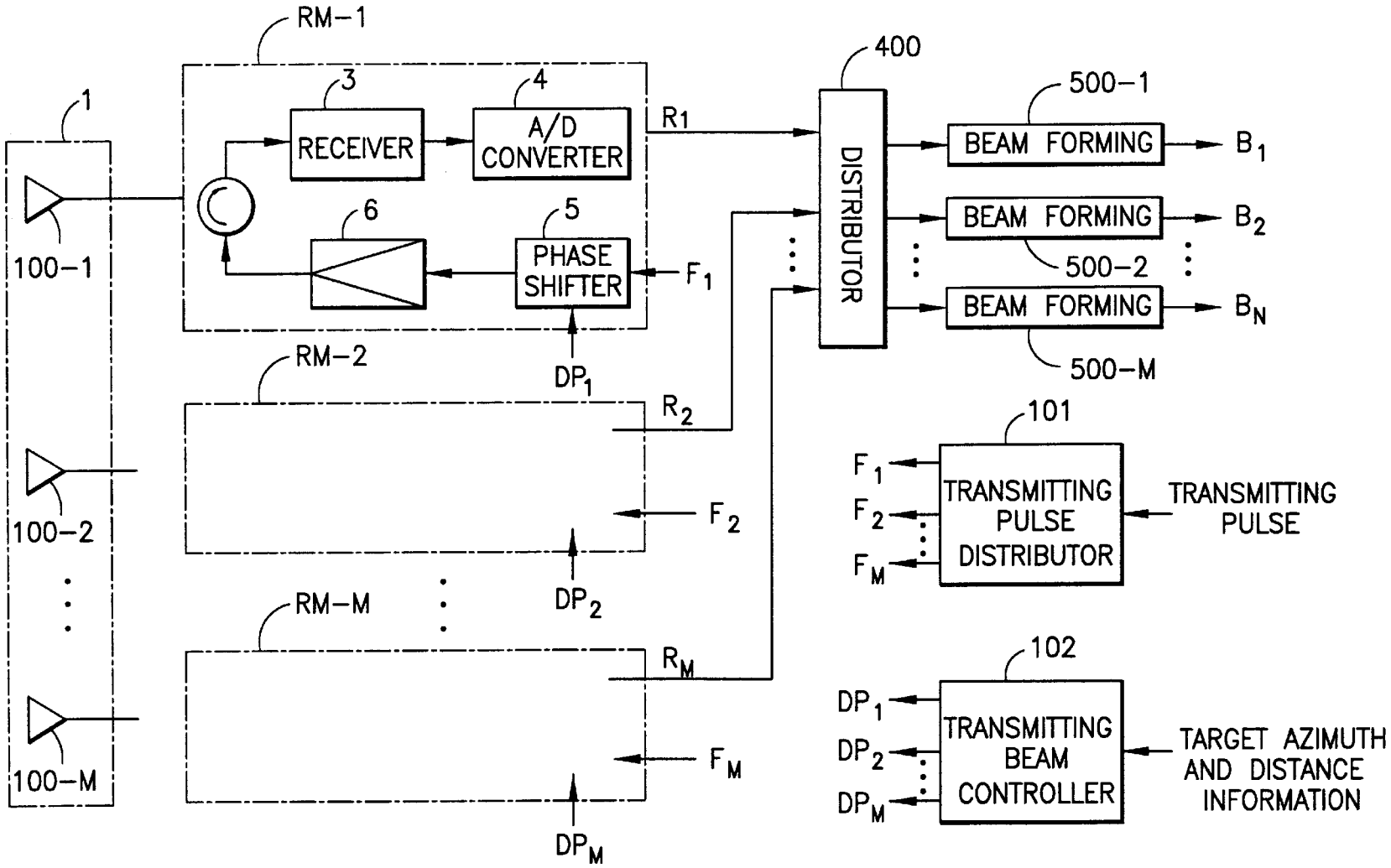
FIG. 1 PRIOR ART
FIG. 1 is a block diagram of a prior art conventional phased array radar apparatus.
Figure 2:
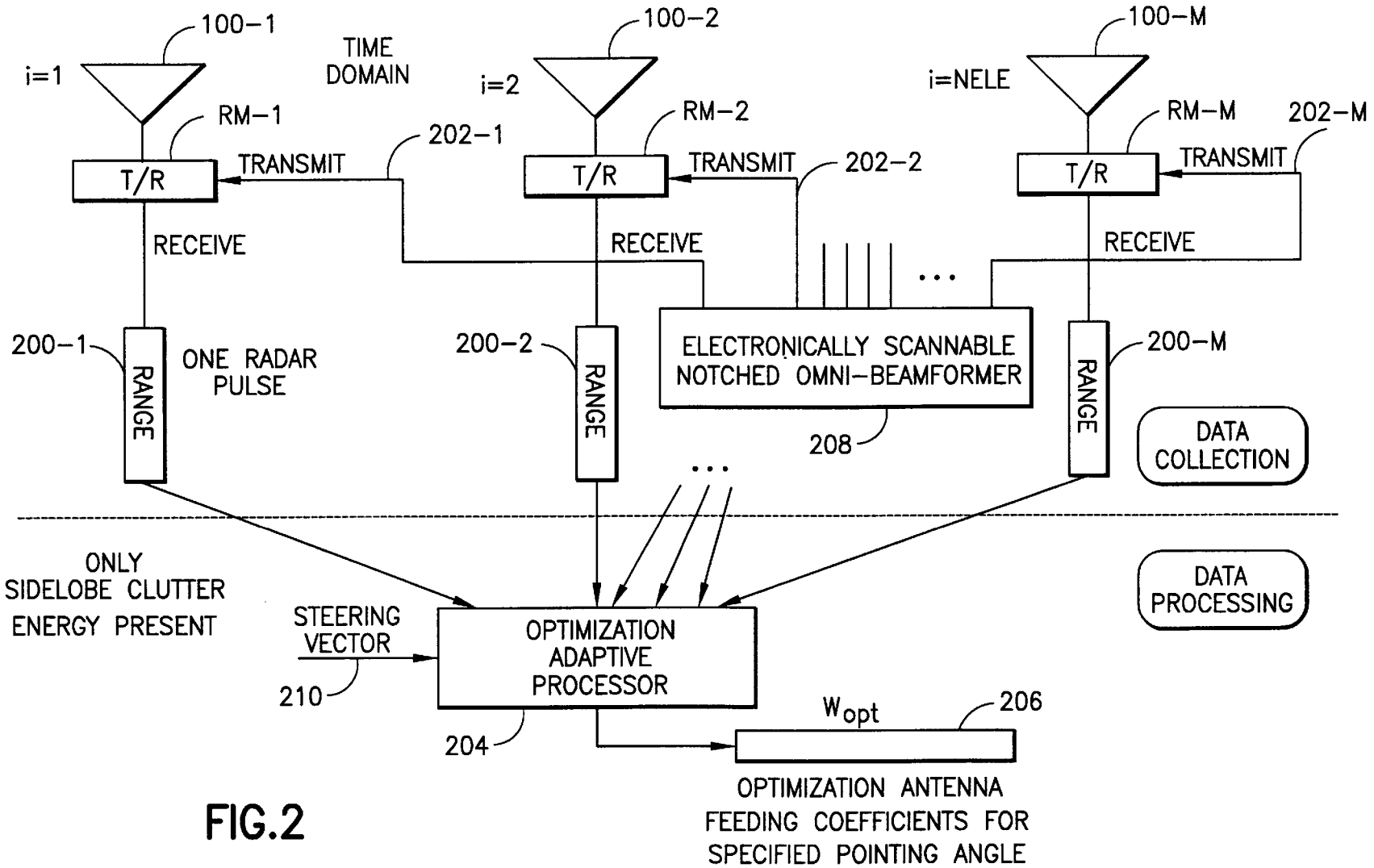
FIG. 2 is a block diagram illustrating the functional elements for determining the optimized antenna feeding coefficients.

FIG. 2 is a high-level diagram of the functional elements forming a synthesized transmission beam of component beams 202-1 through 202-M, and receiving return signals 200-1 through 200-M, and computing optimized antenna feeding coefficients 206. In FIGS. 1 and 2, associated blocks and arrows represent functions of the process according to the present invention which may be implemented as electrical circuits and associated wires or data buses which transport electrical signals. One or more associated arrows may represent communication (e.g., data flow) as in a digital processing of data. The functions disclosed in FIG. 2 and FIG. 3 can be implemented in the conventional architecture of FIG. 1, as well as in other phased array antenna architectures. Below, only one representative element of the phased array radar, such as 100-1 and associated elements will be generally used to describe the operation of the present invention.

Referring to FIG. 2, a plurality of transmit pulses, as exemplified by a single transmit pulse 202-1, is generated by the actions of an omni-beamformer 208, transmission and reception module RM-1, and the antenna array 100-1 to excite the full 360 degree sector around the aircraft. A typical transmit pattern 401 of the invention (shown in FIG. 4) has a notch 406 placed directly about the desired antenna pointing angle.

The omni-beamformer 208 provides a phase and an amplitude adjustment for the radiated signals in the form of feeding coefficients to alter the angle of RF transmission. Once a set of complex feeding coefficients are computed for the transmit beamformer 208, it is only necessary to electronically adjust it for applications to other azimuth antenna angles.

Figure 4:
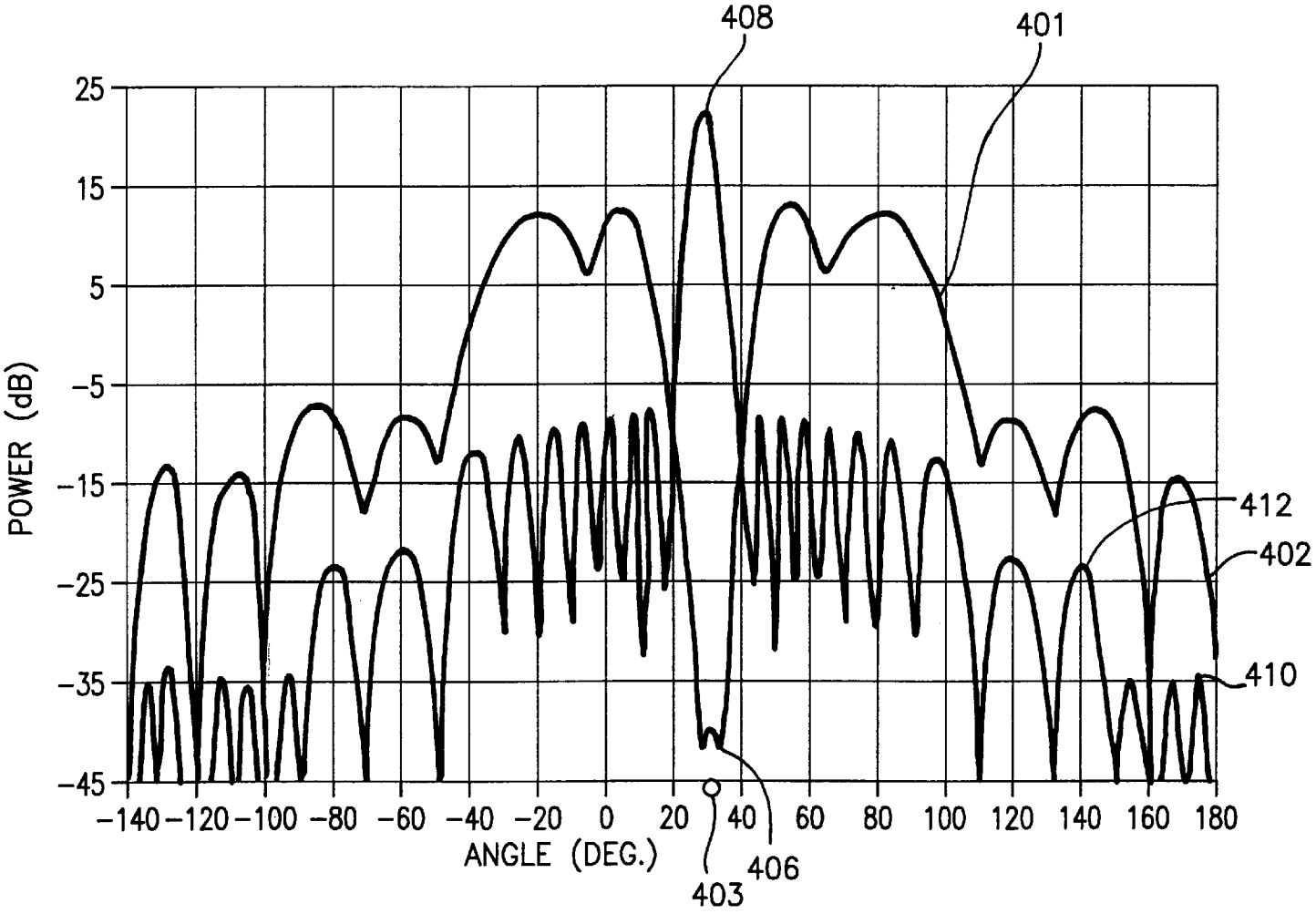
FIG. 4 is a radiation pattern of a typical transmit pattern projected on a synthesized transmit pattern.

FIG. 4 shows a typical transmit pattern 412 of the prior art, the pattern having a main lobe 408. The pulse 202-1 (FIG. 2) is synthesized by superimposing the feeding coefficients of a number of scanned sum patterns (whose edges overlap), with the one at boresight. Upon subtraction of each of these scanned patterns from the unscanned boresight pattern, as shown in FIG. 4, transmit pattern 401, in accordance with the invention, is obtained which has a broad rectangular main lobe notch 406 about the antenna boresight 403. The transmit pulse 202-1, derived by selecting a set of feeding coefficients, and is outputted by the antenna array 1 as a single RF pulse for exciting the environment and collecting signal returns.

Returns 200-1 from the transmitted pulse 202-1 are collected in a conventional manner, however, any signal returns that are received during this calibration process will predominately represent ground clutter echoes and reflections. In fact, the absence of any main lobe in the transmission pulse 202-1 implies that any return energy is a reflection of targets illuminated by antenna 100-1 sidelobes 402 and therefore contain information regarding distortions or misalignments produced by the placement of a phased-array antenna 100-1 on an aircraft platform.

The clutter data is ideally collected in an environment as close to isotropic as possible so that the computed antenna feeding coefficients correct for the presence of the airframe rather than variations in the clutter distributions. Since a single transmit pulse, such as 202-1, is used and data 200-1 is collected at short range, the predominant RF signal from these returns represents reflections from clutter. If the clutter is fairly homogeneous, the best possible optimization results will be obtained, because homogeneous clutter excites the environment equally in all the sidelobe 410 regions.

Referring to FIG. 1, RF signal returns are captured by a radar receiver 3 and digitized by analog to digital (A/D) converters 4. A statistically significant ensemble of range data samples 200-1, typically twice the number of antenna elements M, are collected and utilized to form a processing covariance matrix. The returns 200-1 through 200-M (FIG. 2) are used to derive the optimization feeding coefficients 206. The optimization adaptive processor 204 forms a covariance matrix by computing the cross-correlation terms of the collected range samples across the elements of the array by employing a modified Weiner-Hopf algorithm. The covariance matrix is then inverted and post-multiplied by a steering vector 210 having M components which is the dimensionality of the antenna array 1. The steering vector 210 represents an amplitude taper distribution, typically associated with windowing functions for reducing the system sidelobe response. The distribution utilized may follow either a Dolph-Chebychev or Taylor series. An ideal antenna in free-space employing a 40 dB Dolph-Chebychev taper results in an antenna pattern that exhibits a response with peak sidelobe levels 40 dB down from the antenna peak levels.

In further detail, with respect to the utilization of the Wiener-Hopf algorithm, the transmit pattern for a single beam in a specific direction is obtained by assigning weighting (or feeding) coefficients to signals transmitted by respective ones of the radiating elements of a phased array antenna. Two or more separate beams, oriented in different directions, may be generated concurrently by superposition of the signals of respective beams, one upon the other. The resultant signal from each of the respective radiating elements may be expressed in terms of a further feeding coefficient. Thus, an antenna radiation pattern composed of a plurality of individual beams can be constructed by a suitable set of feeding coefficients.

In the practice of the invention, it is desired to provide a radiation pattern characterized by a notch in a specific direction, namely, the direction in which target data is to be obtained. The notched pattern enables the radar equipment to obtain data in sidelobe directions which provides for echoes viewed directly from the ground as well as for echoes propagating along paths reflected from the skin of an aircraft carrying the radar equipment. The notched pattern is constructed by the foregoing superposition of signals from a plurality of beams directed in directions of sidelobes of a main beam of the radar.

In the practice of the invention, it is noted that the notched beam receives signals from numerous directions to the exclusion of the direction of the main beam. By inversion of the covariance matrix of the Wiener-Hopf algorithm, the inverse radiation pattern is obtained. The inverse pattern receives signals in the direction of the main beam to the exclusion of signals in the direction of the sidelobes. Since the sidelobe signals include transmissions via propagation paths having a reflection from the skin of the aircraft, the exclusion of the sidelobe signals avoids the detrimental effects of reflections from the aircraft.

The covariance matrix is obtained by observation of signals, such as ground clutter, received by the radar with the notched radiation pattern. For example, in an antenna array of eight radiating elements, eight signals are received, one by each of the respective elements. The signals, preferably, are processed digitally by sampling, and are averaged over an interval of time by accumulation of the samples. In this example, the covariance matrix is an 8 by 8 matrix wherein each term is a product of two of the signals. For example, the first row of the matrix may be obtained by multiplying the received signal of the first radiating element by the respective signals of each of the eight radiating elements to obtain eight products, while the second row of the matrix is obtained by multiplying the received signal of the second radiating element by the received signals of the respective eight elements. Due to the integration, the values of the terms of the covariance matrix are time-averaged values which serve as a mathematical representation of the signals received by the notched antenna pattern.

The covariance matrix is then inverted to obtain the mathematical representation of the signals to be received by the inverse radiation pattern, namely, the main beam to the exclusion of the sidelobe signals and to the exclusion of effects of the airframe. The inverted covariance matrix is then post-multiplied by a steering vector (an 8 by 1 column vector in the foregoing example) to obtain the desired eight feeding coefficients for directing the main beam in a specific direction. The foregoing formation of the matrix and the inversion of the matrix is accomplished by a suitably programmed computer, such programming of mathematical operations being well known.

In the manner of the foregoing, derived coefficients are obtained for each unique antenna pointing angle, operating frequency and scan angle. Consequently, a number of digitized A/D range samples, as exemplified by 200-1, are collected from each of the elements in the array 1 and fed into the optimization adaptive processor 210.

Figure 3:
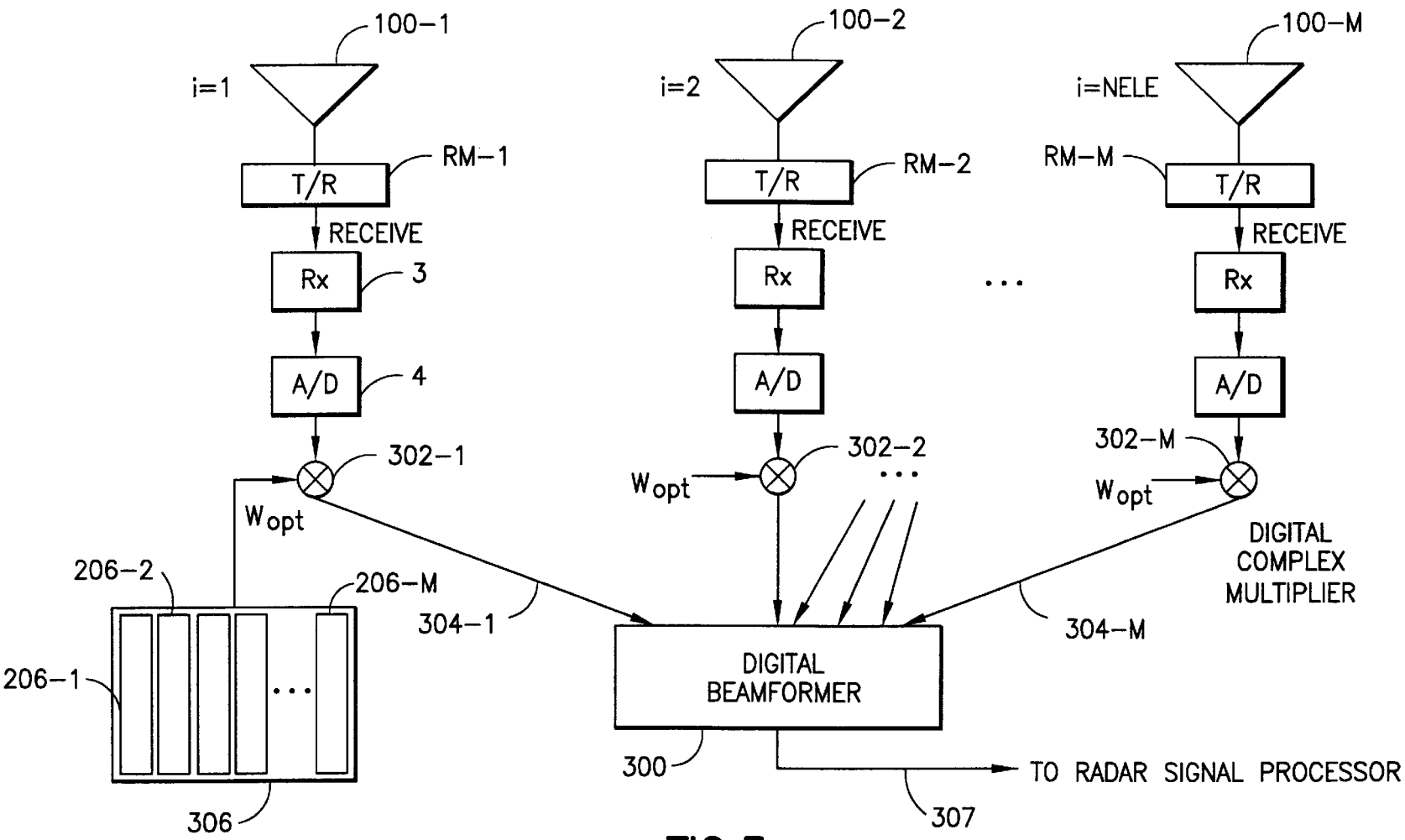
FIG. 3 is a block diagram illustrating the functional elements for applying the optimized antenna feeding coefficients to a received signal.

With reference to FIG. 3, the derived coefficients are stored in a data buffer 306 and are later combined with the digital data at A/D 4 to produce a beam formed output 307. As indicated above, similarly derived coefficients for each unique antenna pointing angle, operating frequency and scan angle are combined with subsequently received signals at A/D 4 as part of the active radar operation. Therefore, each time the radar points in a given beam direction, the corresponding calibrated optimization coefficients are retrieved from the data buffer 306 and applied to digital complex multipliers 302-1 through 302-M, which are further applied to the digital beamformer 300, so as to correct for aircraft induced distortions and misalignments.

Figure 5:
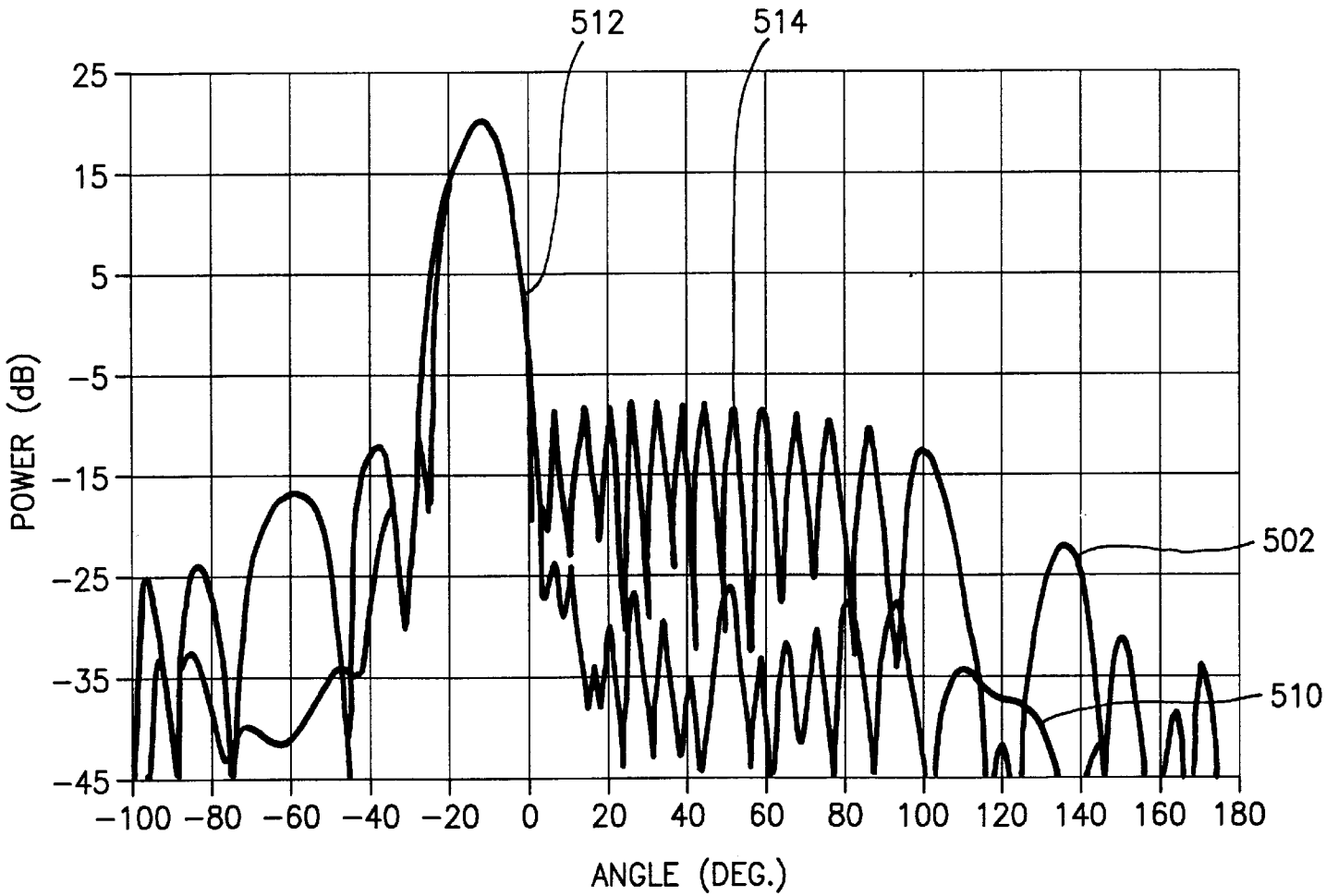
FIG. 5 is a radiation pattern of an ideal non optimized digitally formed receive pattern projected on an optimized digitally formed receive pattern.

Performance results indicate that, typically 9 dB to 15 dB sidelobe level reduction can be achieved. FIG. 5 is a computer simulation utilizing isotropic clutter showing an ideal non optimized digitally formed receive antenna pattern 514 with 30 dB peak sidelobe levels 502. The resultant antenna pattern 512 is obtained when the optimized feeding coefficients are used to form the beam digitally. This case shows a pattern with 39 dB peak sidelobes 510, or a 9 dB improvement over the ideal non optimized pattern sidelobes 502. Similar results are obtained utilizing actual measured flight-worthy, free-space, element pattern data.

While a preferred embodiment of the invention has been shown and described herein, it will be understood that this embodiment is provided by way of example only. Accordingly, it is intended that the appended claims cover all embodiments within the spirit and scope of the claims.

What is claimed is:

1. A method for optimizing an aircraft phased array radar system, the system being operative to produce a transmit radiation pattern having a main lobe in a desired direction, the method comprising the steps of:

synthesizing a first RF transmission signal having a notch in the desired direction;

transmitting said first transmission signal through the phased array antenna;

receiving through the antenna first RF return signal;

processing said first return signal to compute a set of feeding coefficients having a single feeding coefficient for each element of the array, said processing including the forming of an inverse radiation pattern having the main lobe in place of the notch;

transmitting a second signal having said transmit radiation pattern with said main lobe; and applying said coefficients to subsequently received return signals to correct for aircraft induced distortions and misalignments.

2. A method as set forth in claim 1, wherein the first transmission signal comprises a single transmit pulse.

3. A method as set forth in claim 1, further comprising the step of placing the notch in the desired location.

4. A method as set forth in claim 1 comprising the further step of superimposing feeding coefficients of one or more scanned sum patterns with one pattern at the boresight, subtracting from each sum pattern an unscanned boresight pattern and computing therefrom a single feeding coefficient for each element of the antenna array.

5. A method as set forth in claim 1, wherein the processing includes collecting one or more received analog signals representing different return ranges and inputting the signals into a optimization adaptive processor for computing the feeding coefficients.

6. A method as set forth in claim 1, wherein the processing is conducted in the time domain thus, avoiding Doppler frequency foldover problems.

7. A method for optimizing an aircraft phased array radar system, the system being operative to produce a transmit radiation pattern having a main lobe in a desired direction, the method comprising the steps of:

synthesizing a first RF transmission signal having a notch in the desired direction;

transmitting said first transmission signal through the phased array antenna;

receiving through the antenna first RF return signal;

processing said first return signal to compute a set of feeding coefficients having a single feeding coefficient for each element of the array;

transmitting a second signal having said transmit radiation pattern with said main lobe; and applying said coefficients to subsequently received return signals to correct for aircraft induced distortions and misalignments;

wherein the processing includes collecting one or more received analog signals representing different return ranges and inputting the signals into a optimization adaptive processor for computing the feeding coefficients;

utilizing the optimization adaptive processor for computing the feeding coefficients includes the steps of forming a covariance matrix, applying a modified Weiner-Hopf algorithm, computing cross correlation terms, inverting the matrix and post multiplying the matrix by a steering vector for each element in the antenna array.

8. An aircraft phased array radar system comprising:

a means to synthesize an RF transmission signal having a notch in the main beam;

a transmitting means to transmit said signal through the phased array antenna;

a receiving means to receive through the antenna an RF return signal;

a processing means to compute a single feeding coefficient for each element of the array based upon said return signal, said processing means including matrix-forming means operative to provide an inverse radiation pattern having the main lobe in place of the notch;

a means for applying said coefficients to subsequently received return signals to correct for aircraft induced distortions and misalignments.

9. The aircraft phased array radar system as set forth in claim 8, wherein the radar transmission signal is a single transmit pulse.

10. The aircraft phased array radar system as set forth in claim 8, wherein the notch is placed directly about the desired pointing angle.

11. The aircraft phased array radar system as set forth in claim 8, wherein the means to synthesize a transmit pulse includes a means for superimposing feeding coefficients of one or more scanned sum patterns with one pattern at the boresight, a means for subtracting from each sum pattern an unscanned boresight pattern and a means for computing therefrom a single feeding coefficient for each element of the antenna array.

12. The aircraft phased array radar system as set forth in claim 8, wherein the process includes one or more received analog signals representing different return ranges and an optimization adaptive processor utilizing the signals to compute a set of feeding coefficients.

13. An aircraft phased array radar system comprising:

a means to synthesize an RF transmission signal having a notch in the main beam;

a transmitting means to transmit said signal through the phased array antenna;

a receiving means to receive through the antenna an RF return signal;

a processing means to compute a single feeding coefficient for each element of the array based upon said return signal;

a means for applying said coefficients to subsequently received return signals to correct for aircraft induced distortions and misalignments;

wherein the process includes one or more received analog signals representing different return ranges and an optimization adaptive processor utilizing the signals to compute a set of feeding coefficients;

the optimization adaptive processor includes a means for forming a covariance matrix, a means for applying a modified Weiner-Hopf algorithm, a means for computing cross correlation terms, a means for inverting the matrix and means for post multiplying the matrix by a steering vector for each element in the antenna array.

14. An aircraft phased array radar system operative to produce a main beam, comprising:

a means to transmit an RF signal through a phased array antenna with a radiation pattern having a notch;

a means to receive through the antenna an RF return signal;

means to form an inverse radiation pattern having the main lobe in place of the notch; and a means to apply a set of coefficients to the return signal to correct for aircraft induced distortions and misalignments.

15. The aircraft phased array radar system as set forth in claim 14, wherein the means to apply a set of coefficients include a storage device having stored coefficients for optimization therein, an analog to digital converter to convert the received signal to a digital signal and a means for combining the coefficients and the digital signal to produce a beam formed output with controlled sidelobe response.

16. A method for optimizing an aircraft phased array radar system, the system being operative to produce a transmit radiation pattern having a main lobe in a desired direction, the method comprising the steps of:

synthesizing a first RF transmission signal;

transmitting said first transmission signal through the phased array antenna via a radiation pattern having a notch in the desired direction;

receiving through the antenna a first RF return signal;

processing said first return signal to compute a set of feeding coefficients having a single feeding coefficient for each element of the array, said processing including a time-averaging of said first return signal, a formation of a covariance matrix of the first return signal, and an inversion of the covariance matrix to obtain an inverse radiation pattern having the main lobe in the place of the notch;

transmitting a second signal having said transmit radiation pattern with said main lobe; and applying said coefficients to subsequently received return signals to correct for aircraft induced distortions.

17. An aircraft phased array radar system comprising:

a means to synthesize an RF transmission signal having a notch in the main beam;

a transmitting means to transmit said signal through the phased array antenna;

a receiving means to receive through the antenna an RF return signal;

a processing means to compute a single feeding coefficient for each element of the array based upon said return signal, said processing including means for time-averaging said return signal, means for forming a covariance matrix of the return signal, and means for inverting the covariance matrix to obtain an inverse radiation pattern having the main lobe in the place of the notch; and means for applying said coefficients to subsequently received return signals to correct for aircraft induced distortions.

* * * * *